US009889572B2

(12) United States Patent
Bucco

(10) Patent No.: US 9,889,572 B2
(45) **Date of Patent: *Feb. 13, 2018**

(54) RAZOR WITH CUTTING BLADE ROTATABLE ABOUT MULTIPLE AXES

(71) Applicant: Thomas J. Bucco, Setauket, NY (US)

(72) Inventor: Thomas J. Bucco, Setauket, NY (US)

( * ) Notice: Subject to any disclaimer, the term of this patent is extended or adjusted under 35 U.S.C. 154(b) by 147 days.

This patent is subject to a terminal disclaimer.

(21) Appl. No.: 14/266,913

(22) Filed: May 1, 2014

(65) Prior Publication Data

US 2014/0237828 A1 Aug. 28, 2014
US 2015/0075015 A2 Mar. 19, 2015

Related U.S. Application Data

(63) Continuation of application No. 13/030,752, filed on Feb. 18, 2011, now Pat. No. 8,720,072.

(60) Provisional application No. 61/372,662, filed on Aug. 11, 2010.

(51) Int. Cl.
*B26B 21/00* (2006.01)
*B26B 21/52* (2006.01)

(52) U.S. Cl.
CPC ..... *B26B 21/521* (2013.01); *B26B 21/522* (2013.01)

(58) Field of Classification Search
CPC ..... B26B 21/521; B26B 21/522
USPC ..... 30/527, 529, 32
See application file for complete search history.

(56) References Cited

U.S. PATENT DOCUMENTS

| | | | | |
|---|---|---|---|---|
| 831,259 | A | 9/1906 | Bingler | |
| 1,015,575 | A | 1/1912 | Meyer | |
| 1,450,604 | A * | 4/1923 | Mossberg | B26B 21/52 30/529 |
| 1,455,751 | A | 5/1923 | Hartman | |
| 1,552,234 | A | 9/1925 | Roebuck | |
| 1,639,441 | A | 8/1927 | Spahr | |
| 1,693,532 | A | 12/1927 | Stewart | |
| 2,083,172 | A | 6/1937 | Smith | |
| 2,119,792 | A * | 6/1938 | Parkin | B26B 21/52 30/531 |

(Continued)

FOREIGN PATENT DOCUMENTS

| | | | |
|---|---|---|---|
| CA | 1045365 | A1 | 1/1979 |
| DE | 202004014032 | U1 | 1/2005 |

(Continued)

*Primary Examiner* — Ghassem Alie
*Assistant Examiner* — Bharat C Patel
(74) *Attorney, Agent, or Firm* — Ryan, Mason & Lewis, LLP

(57) ABSTRACT

A razor includes a handle and detachable blade cartridge. The end of the handle has a pivot sphere upon which the blade cartridge is rotatably mounted, with freedom to pivot around three axes of the handle, and otherwise holds its orientation relative to the handle. The blade cartridge is held to the pivot sphere by a clevis having recesses defined in at least the inner side surfaces of its legs. The recesses, together with the clevis, are sized to admit the pivot sphere between them and to hold the sphere therein once admitted. The clevis and/or the pivot sphere can be formed of a resilient injection molded plastic. The range of motion of the blade cartridge can be limited by forming one or more stops on the pivot sphere to interact with the clevis and thereby interrupt its free rotation.

14 Claims, 1 Drawing Sheet

(56) References Cited

U.S. PATENT DOCUMENTS 2,165,046 A * 7/1939 Greenstein ..... B26B 21/16 30/64
2,194,815 A 3/1940 Testi
2,211,255 A 8/1940 Claassen
2,502,585 A * 4/1950 Oberheim ..... B26B 21/30 30/61
2,510,951 A * 6/1950 Bleeker ..... B26B 21/24 30/40
2,844,870 A 7/1958 Roces et al.
3,935,639 A 2/1976 Terry et al.
3,950,848 A 4/1976 Goldstein
3,950,849 A 4/1976 Perry
3,964,160 A 6/1976 Gordon
4,083,103 A * 4/1978 Estandian ..... B26B 21/52 30/47
4,152,828 A * 5/1979 Lund ..... B26B 21/225 30/529
4,163,316 A * 8/1979 Hagmann ..... B26B 21/528 30/47
4,275,498 A 6/1981 Ciaffone
4,347,663 A 9/1982 Ullmo
4,403,414 A 9/1983 Kiraly et al.
4,446,619 A 5/1984 Jacobson
4,475,286 A 10/1984 Saito
4,488,357 A 12/1984 Jacobson
4,573,266 A 3/1986 Jacobson
4,797,998 A 1/1989 Motta
4,922,609 A 5/1990 Grange
4,926,553 A * 5/1990 Miskin ..... B26B 21/225 30/49
5,007,168 A * 4/1991 Messinger ..... B26B 19/146 30/41.5
5,029,391 A 7/1991 Althaus et al.
5,070,614 A * 12/1991 Hardin ..... B26B 21/521 30/527
5,093,991 A 3/1992 Hendrickson
5,167,069 A * 12/1992 Quinn ..... B26B 21/523 30/527
5,347,717 A * 9/1994 Ts'ai ..... B26B 21/225 30/50
5,526,568 A * 6/1996 Copelan ..... B26B 21/52 30/531
5,535,518 A 7/1996 Althaus
5,560,106 A * 10/1996 Armbruster ..... B26B 21/522 30/526
5,606,799 A * 3/1997 Melton ..... B26B 19/063 30/199
5,678,316 A 10/1997 Althaus et al.
5,704,127 A 1/1998 Cordio
5,771,591 A 6/1998 Armbruster et al.
5,787,593 A 8/1998 Althaus
5,953,824 A * 9/1999 Ferraro ..... B26B 21/225 30/527
6,115,924 A 9/2000 Oldroyd
6,223,422 B1 5/2001 Pina
6,301,786 B1 10/2001 Oswald et al.
6,311,400 B1 * 11/2001 Hawes ..... B26B 21/225 30/50
6,381,857 B1 5/2002 Oldroyd
6,615,498 B1 * 9/2003 King ..... B26B 21/225 30/527
6,880,253 B1 * 4/2005 Gyllerstrom ..... B26B 21/14 30/50
7,137,205 B2 11/2006 Royle
7,140,116 B2 * 11/2006 Coffin ..... B26B 21/28 30/527
7,461,456 B2 12/2008 Tsushio et al.
7,475,483 B2 1/2009 Peyser et al.
7,802,368 B2 9/2010 Coffin et al.
8,205,343 B2 6/2012 Winter et al.
8,205,344 B2 6/2012 Stevens
8,474,144 B2 7/2013 Royle
8,671,577 B2 * 3/2014 Brown ..... B26B 21/225 30/50
8,745,882 B2 6/2014 Murgida et al.
8,745,883 B2 6/2014 Murgida et al.
9,108,329 B2 * 8/2015 Stiles ..... B26B 21/22
2004/0035003 A1 * 2/2004 Stiles ..... B26B 21/22 30/50
2004/0177519 A1 9/2004 Tomassetti et al.
2004/0181953 A1 * 9/2004 Follo ..... B26B 21/521 30/527
2008/0034591 A1 2/2008 Fung
2008/0086899 A1 * 4/2008 Gallagher ..... B26B 21/521 30/526
2009/0255124 A1 * 10/2009 Hasbani ..... B26B 21/225 30/50
2009/0313837 A1 12/2009 Winter et al.
2010/0043242 A1 * 2/2010 Stevens ..... B26B 21/521 30/527
2010/0313426 A1 12/2010 Royle
2011/0035950 A1 2/2011 Royle

FOREIGN PATENT DOCUMENTS

DE 202006011254 12/2006
EP 0885697 A1 12/1998
EP 14002018 8/2014
FR 2639280 5/1990
GB 2458316 A 9/2009
GB 2463035 3/2010
WO 2011094887 A1 8/2011
WO PCT/US2011/047330 1/2012
WO 2012021666 A1 2/2012

* cited by examiner

RAZOR WITH CUTTING BLADE ROTATABLE ABOUT MULTIPLE AXES

CROSS-REFERENCE TO RELATED APPLICATIONS

The present application is a continuation of U.S. application Ser. No. 13/030,752, filed Feb. 18, 2011 and now patented as U.S. Pat. No. 8,720,072, which claims the benefit of U.S. Provisional Application Ser. No. 61/372,662, filed Aug. 11, 2010.

BACKGROUND

Field

The present invention relates to the field of consumer products and particularly to a razor with blade holder that is pivotable around three axes.

Description of Related Art

In a shaving tool for personal grooming, one well-known design is the safety razor that has a blade cartridge holding one or more blades at an appropriate angle for shaving, with the blade cartridge connected to a handle. As the face, etc. or other body portion being shaven is not flat, the user must articulate the handle around three axes while moving the blade over the skin to achieve a suitable result. This requires a certain level of dexterity on the part of the user.

In recognition of this, it is known to mount the blade cartridge to the handle in a manner to allow the blade cartridge to pivot around an axis parallel to the cutting edge(s) of the blades. However, this limited range of motion still requires the manual dexterity of the user to rotate the blade around other axes. Therefore, a better solution is lacking.

SUMMARY

A razor according to the instant disclosure includes a handle and detachable blade cartridge. The end of the handle has a pivot sphere upon which the blade cartridge is rotatably mounted, with freedom to pivot around three axes of the handle, and otherwise holds its orientation relative to the handle. The blade cartridge is held to the pivot sphere by a clevis having recesses defined in at least the inner side surfaces of its legs. The recesses, together with the clevis, are sized to admit the pivot sphere between them and to hold the sphere therein once admitted. The clevis and/or the pivot sphere can be formed of a resilient injection molded plastic. The range of motion of the blade cartridge may be limited by forming one or more stops on the pivot sphere to interact with the clevis and thereby interrupt its free rotation.

In a particular embodiment, a personal grooming apparatus comprises a handle having a gripping portion and an attachment portion operative to rotably support a cartridge for rotational movement around at least two axes. The cartridge includes a clevis with first and second opposed legs, spaced from one another, each of the first and second legs having a respective recess in a side facing the opposing leg, the respective recesses sized, shaped and positioned such that the attachment portion is received simultaneously in both recesses, with the cartridge being pivotably mounted upon the attachment portion with freedom of motion around at least two axes.

In a further embodiment, the cartridge comprises a central recess between the first and second legs receiving and substantially covering an end of the attachment portion. The attachment portion may comprise a sphere or part thereof having a first radius. The sphere or part thereof may comprise a plurality of elements approximating the surface of the sphere. At least one of the plurality of elements approximating the surface of the sphere may be resilient to facilitate attachment between the sphere or part thereof with the cartridge.

In a further embodiment, the central recess may comprise either a spherical section or a toroidal section, the spherical section or toroidal section being defined by a radius substantially equal to, or greater than, the first radius of the sphere or part thereof.

The recesses in each of the first and second legs may be either cylindrical or spherical recesses. At least one of the recesses in each of the first and second legs may be a through opening that perforates the side of its respective first or second leg facing away from the opposing leg.

In a further embodiment, at least one of the first and second legs comprises a relief portion inclined toward the opposing one of said first and second legs, said relief portion being operative to facilitate the insertion of the attachment portion between the first and second legs. The relief portion may comprise a spherical section surface, optionally having a radius substantially equal to or greater than that of the sphere of the attachment potion, where the attachment portion is provided with a sphere or part thereof.

In a particular embodiment, at least one of the first and second legs comprise a resilient material, said leg being operative to deflect under the pressure of the attachment portion upon insertion of the attachment portion between the first and second legs, and thereby admit the attachment portion between the first and second legs.

In a further embodiment, the attachment portion further comprises at least one stop extending above its surface to partially obstruct the rotation of the cartridge when the cartridge is mounted upon the attachment portion. In a further embodiment, two symmetric and diametrically opposed stops are provided.

The cartridge may be mounted on the attachment portion operative to hold the orientation of the cartridge with respect to the handle at rest, yet pivot freely under an applied pressure.

The attachment portion may comprise an attachment arm by which it is mounted to the handle. The attachment arm may extend at an angle to the axis of the handle. The attachment arm may further be configured to reduce in diameter, for example as a frusto-conical shape, and may further be attached to the handle by the relatively larger-diameter portion of the attachment arm.

These and other features, advantages and benefits of the present disclosure will become apparent from the following description.

DETAILED DESCRIPTION OF THE FIGURES

DETAILED DESCRIPTION OF THE EMBODIMENTS

Figure 1:
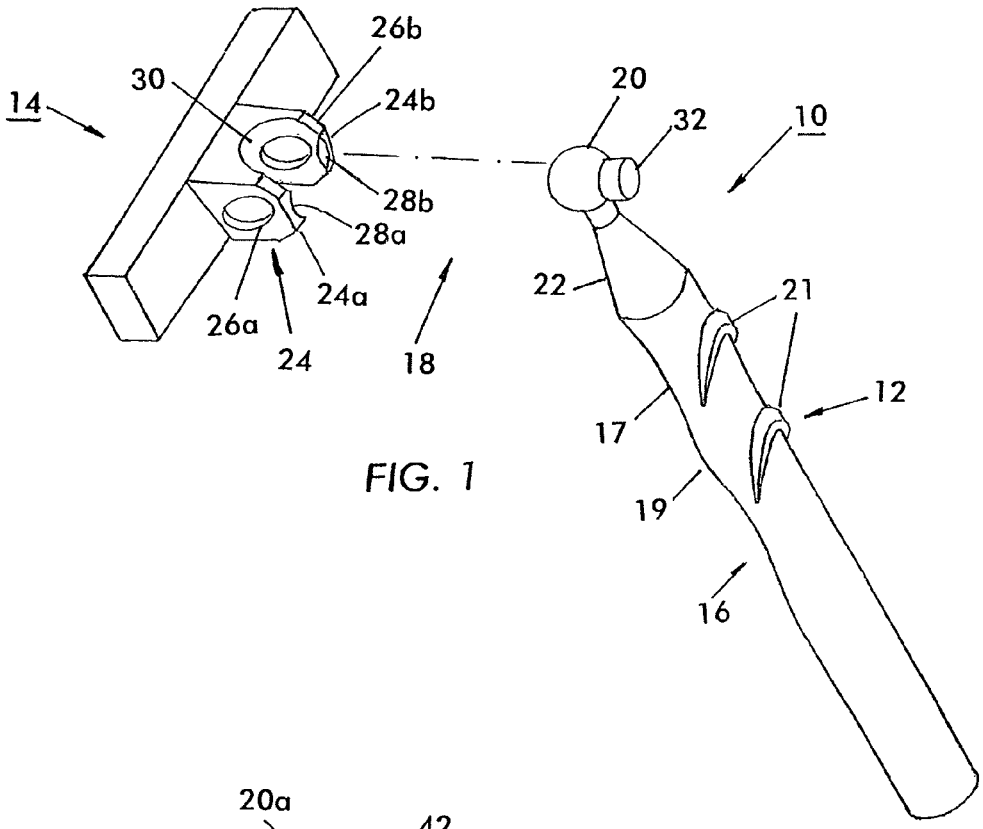
FIG. 1 illustrates a razor according to an exemplary embodiment of the present disclosure, in an exploded assembly view wherein a blade cartridge thereof is separated from the handle along the phantom line.

Referring now to FIG. 1, illustrated is an exploded assembly view of a three axis safety razor, generally 10, according to an exemplary embodiment of the present disclosure. The razor 10 includes a handle 12, and a blade cartridge 14 pivotally connected to the handle 12. The handle 12 includes a gripping portion 16. The gripping portion 16 is illustrated as generally cylindrical, however, it is contemplated, and, in fact, preferred that the gripping portion 16 have some features to enhance its friction when held in the hand of the user.

Among these features, without limitation, the shape of the gripping portion 16 may be varied from the generally right circular cylinder as illustrated, for example, to other prismatic shapes such as triangular, rectangular (including square) or hexagonal prisms, among others, and/or to optionally include some combination of lands and curves. The gripping portion 16 may be further provided with one or more localized depressions 17 and/or protuberances 19 to receive the fingers of a user's hand. The surface of the gripping portion 16 may be provided with texture and/or friction enhancements, including without limitation knurling, localized or general surface roughening, and friction-enhancing appliqués 21, including those which may raise the height of the surface to which they are applied.

At a first end 18 of the handle 12, a pivot sphere 20 is secured to and/or made part of the handle 12. Designating the structure as a pivot sphere does not preclude the possibility that the pivot sphere may be only partially spherical, as described further below. In a further embodiment, shown for example in FIG. 2, the pivot sphere may be formed by a plurality of elements 40 approximating a sphere (or part thereof). Optionally, those elements 40 may themselves be resilient to deform from a spherical surface to permit the pivot sphere 20*a* to be connected with the blade cartridge 14. Moreover, in the embodiment illustrated in FIG. 2, the gaps 42 between elements 40 are substantially parallel with one another and circumferential with the sphere 20*a*. This need not be the case, however. As well, the gaps may be formed around poles of the sphere that are not substantially aligned with the stops 32*a*, 32*b*, as illustrated. For example, the gaps 42 may be formed to meet at or near the attachment with arm 22. Other variations will be apparent to those of skill in the art, in light of the instant disclosure.

Returning to the exemplary embodiment, pivot sphere 20 is mounted to the handle 12 at the end of an arm 22. Arm 22 preferably achieves a reduction in diameter from the gripping portion 16 of the handle 12, to reduce and/or avoid obstructing the pivoting of the blade cartridge 14 about the pivot sphere 20. In the exemplary embodiment, arm 22 is frusto-conical in shape, with a smaller diameter end adjacent to and connected with the pivot sphere. Moreover, the arm 22 may be offset such that its longitudinal axis diverges from a longitudinal axis of the handle 12 generally, or gripping portion 16 specifically, in order to further distance the blade cartridge 14 from the handle 12. In alternate embodiments, the arm 22 supporting the pivot sphere 20 may be mounted along the length of the handle 12, rather than at or near an end. One manner of mounting the arm 22 may be substantially perpendicular to the axis of the handle 12, approximating a "T"-shape between the handle 12 and the arm 22. Other configurations, e.g., "C", "J", "L", "Y"-shaped combinations of handle 12 and arm 22, are clearly conceivable within the scope of the instant disclosure.

Blade cartridge 14 includes a clevis 24 for pivotably securing the blade cartridge 14 to the pivot sphere 20. The clevis 24 includes two opposed legs 24*a*, 24*b*. Each leg 24*a*, 24*b* has a hole 26*a*, 26*b*, respectively. In the exemplary embodiment, holes 26*a*, 26*b* are through holes which traverse their respective legs 24*a*, 24*b*, however, they need not perforate the legs 24*a*, 24*b* entirely. Holes 26*a*, 26*b* are sized and spaced such that the clevis 24 can be installed over the pivot sphere 20, and be retained there in connection with the handle 12. The tolerances of fit between the clevis 24, specifically holes 26*a*, 26*b*, and pivot sphere 20, are readily adjustable by those having skill in the art without departing from the scope of the present disclosure. In a preferred embodiment, the tolerances are set to achieve a fit between clevis 24 and sphere 20 such that the cartridge 14 holds its orientation with respect to the handle 12 at rest, yet pivots freely under any applied pressure.

In the exemplary embodiment, the clevis 24 is optionally provided with a recess 30, between legs 24*a*, 24*b* and below holes 26*a*, 26*b*. The recess may be configured as a spherical section, or alternately may resemble a portion of a torus. The radius of the recess 30 when configured as a spherical section, or the outer radius of the torus section where configured as such, is preferably no smaller than the diameter of the pivot sphere 20. The recess should not interfere with the pivoting of the blade cartridge on the pivot sphere. A close fit between the pivot sphere 20 and the recess 30 may enhance the ability of the cartridge 14 to hold its position, and can also inhibit the ingress of water or shaving detritus (e.g., foam, cut hair, etc.) that might inhibit the ability of the cartridge to change position under pressure.

The nature of the fit between the clevis 24 and the pivot sphere 20 is that the maximum diameter of the pivot sphere 20 is greater than the distance between the legs 24*a*, 24*b*, and their included holes 26*a*, 26*b*, or more specifically, the nearest facing surfaces of legs 24*a*, 24*b* and/or holes 26*a*, 26*b*. To accommodate the assembly of the cartridge 14 with the handle 12, either the pivot sphere 20, or one or both of legs 24*a*, 24*b*, or any of them, may be constructed of a resilient material which yields to the degree necessary to mate the cartridge 14 to the handle 12, yet return to their previous respective states once assembled.

The clevis 24 may be provided with one or more relief portions 28*a*, 28*b* as illustrated. Relief portions in this exemplary embodiment are generally spherical sections, and preferably have a radius at least as great as that of the pivot sphere 20. Relief portions 28*a*, 28*b* guide and ease the interface between the pivot sphere 20 and the clevis 24 on their assembly. In connection with this, making the interface between the pivot sphere 20 and the clevis 24 easy and reliable makes it possible to allow the user to exchange and replace the blade cartridge 14 at that interface in the ordinary course of use. This eliminates the need for an additional point of separation to achieve a blade change, thereby simplifying the construction of the blade cartridge 14. However, this does not exclude an additional point of separation, pivoting and/or articulation in connection with blade cartridge 14 described in the present disclosure.

The clevis 24 described herein is advantageously formed of an injection molded plastic and/or metal, for economic benefits in cost of material and manufacture. Alternately, the clevis 24 can be formed and injection molded integrally with the frame of the blade cartridge 14, which is completed by the addition of the blades themselves, among other accessories as desired.

As described above, a razor 10 has a blade cartridge 14 that can freely move around three axes of the handle 12. However, while such freedom of motion is desirable, it may be further desired to limit the range of motion of the blade cartridge 14, for example to avoid extreme or unusual orientations of the blade cartridge 14. This can be accomplished by altering the shape of the pivot sphere 20, for example to provide a stop 32. The stop 32 is sized and positioned to obstruct the clevis 24, and thereby limit its range of motion about the pivot sphere 20. In the exemplary embodiment disclosed, the stop 32 is formed integrally with the remainder of the pivot sphere 20, as a molded part thereof. Alternately, the stop 32 may be a separate structure, secured either permanently or removably to the pivot sphere 20, for example, without limitation, by adhesive or fastener. One or more such stops 32 may be provided, which individually or in combination can permit nearly any desired range of motion in the blade cartridge 14 about the handle 12.

The stop 32 is illustrated in FIG. 1 as a simple circular cylindrical projection. However, the size, shape and height of the stop 32, or several of them, may be selected as desired in consideration of the shape of the clevis 24 and specifically its legs 24*a*, 24*b*. The stop 32 may be shaped to obstruct movement in certain orientations, but not in others. As an example only, once connected in the orientation illustrated in FIG. 1, the stop 32 largely inhibits the lateral rotation of the blade cartridge 14. On the other hand, the blade cartridge 14 is free to rotate about its transverse axis, to 'lift its head' in a manner of speaking. Having done so, the blade cartridge now has additional freedom of lateral rotation, not possible in the prior orientation because of the interaction of the legs 24*a*, 24*b* with the stop 32. This discussion is offered merely as an example of the possible range of motion that could be obtained by the configuration of the stop 32, and further alteration will be apparent to those of ordinary skill in the art in light of the instant disclosure.

Figure 2:
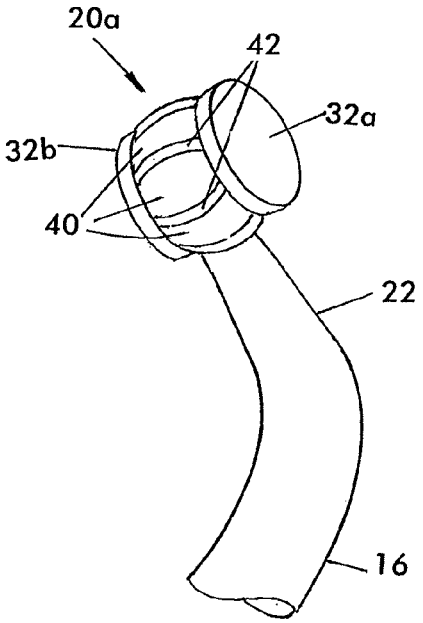
FIG. 2 illustrates an alternate embodiment of a razor according to the present disclosure, as a detail view of the end of handle.

In one embodiment, illustrated in FIG. 2, two such stops 32*a*, 32*b* are substantially diametrically opposed to one another on the pivot sphere 20. Stops 32*a*, 32*b* are, in this embodiment formed by deforming a spherical section into a plane, with the excess material rising above the surface of the sphere 20 to restrict the movement of the blade cartridge 14. The embodiment of FIG. 2 includes the planes formed by this method of creating stops 32*a*, 32*b* being angled with respect to one another. The planes are closer together at the attachment of the sphere 20 with the arm 22. They may, in other embodiments, be angled differently, or parallel with each other.

The foregoing disclosure has been made with reference to certain exemplary and/or preferred features and embodiments. These are not limiting upon the scope of the disclosure. Certain modification, alterations, or substitutions will be apparent to those of ordinary skill in the art in light of the present disclosure.

What is claimed is:

1. A personal grooming apparatus, comprising:

a handle having a gripping portion and an attachment portion, the attachment portion including a pivot member having an at least partially spherical surface; and a cartridge removably attached to the attachment portion and supporting at least one cutting blade;

wherein rotation of the at least one cutting blade is enabled by a clevis comprising two opposed legs having spaced-apart ends, the pivot member of the attachment portion pivotably held between the spaced-apart ends of the two opposed legs of the clevis; and a stop extending from and above the at least partially spherical surface of the pivot member and configured to limit rotation of the cartridge when the cartridge is mounted on the attachment portion;

wherein the stop is configured to limit rotation of the cartridge by interacting with a relief portion of at least one of the two opposed legs of the clevis; and wherein the two opposed legs of the clevis have respective holes formed therein, and wherein the spherical pivot member is pivotably held between the holes formed in the two opposed legs of the clevis.

2. The personal grooming apparatus of claim 1, wherein the gripping portion supports an at least partial spheroid including the pivot member.

3. The personal grooming apparatus of claim 1, wherein the two opposed legs form a portion of the cartridge.

4. The personal grooming apparatus of claim 1, wherein the gripping portion includes friction enhancing depressions and protuberances.

5. The personal grooming apparatus of claim 1, wherein a portion of the cartridge limits rotation of the at least one cutting blade.

6. A razor handle, comprising:

an elongate body having a gripping portion;

a pivot member at one end of the body, the pivot member providing a removable attachment to a cartridge supporting at least one cutting blade;

wherein the pivot member includes an at least partially spherical surface configured to be held between spaced-apart ends of two opposed legs of a clevis; and a stop protruding from the at least partially spherical surface of the pivot member and configured to limit rotation of the pivot member;

wherein the stop is configured to limit rotation of the pivot member by interacting with a relief portion of at least one of the two opposed legs of the clevis; and wherein the two opposed legs of the clevis have respective holes formed therein, and wherein the spherical pivot member is pivotably held between the holes formed in the two opposed legs of the clevis.

7. The razor handle apparatus of claim 6, wherein the gripping portion supports a spheroid including the pivot member.

8. The razor handle of claim 6, wherein the two opposed legs extend from the cartridge.

9. The razor handle of claim 6, wherein the gripping portion includes friction enhancing depressions and protuberances.

10. The razor handle of claim 6, wherein the gripping portion includes a friction enhancing attachment to the elongate body.

11. A razor, comprising:

a cartridge supporting at least one cutting blade;

a handle having an elongate gripping portion and an attachment portion at one end of the handle, the attachment portion supporting a pivot member providing a removable attachment to the cartridge;

wherein the pivot member includes an at least partially spherical surface and is configured to be held between spaced-apart ends of two opposed legs of a clevis; and a stop protruding from the at least partially spherical surface of the pivot member and configured to limit rotation of the cartridge when the cartridge is mounted on the attachment portion;

wherein the stop is configured to limit rotation of the cartridge by interacting with a relief portion of at least one of the two opposed legs of the clevis; and wherein the two opposed legs of the clevis have respective holes formed therein, and wherein the spherical pivot member is pivotably held between the holes formed in the two opposed legs of the clevis; and wherein the two opposed legs of the clevis have respective holes formed therein, and wherein the spherical pivot member is pivotably held between the holes formed in the two opposed legs of the clevis.

12. The razor of claim 11, wherein the two opposed legs extend from the cartridge.

13. The razor of claim 11, wherein the gripping portion includes friction enhancing depressions and protuberances.

14. The razor of claim 11, wherein a portion of the cartridge limits rotation of the at least one cutting blade.

* * * * *